US006411158B1

(12) United States Patent
Essig

(10) Patent No.: US 6,411,158 B1
(45) Date of Patent: Jun. 25, 2002

(54) BANDGAP REFERENCE VOLTAGE WITH LOW NOISE SENSITIVITY

(75) Inventor: Daniel L. Essig, Cardiff by the Sea, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/390,072

(22) Filed: Sep. 3, 1999

(51) Int. Cl.[7] ..... G05F 1/10; G05F 3/02
(52) U.S. Cl. ..... 327/539; 323/313
(58) Field of Search ..... 327/530, 538, 327/539, 512, 513; 323/313, 315, 316

(56) References Cited

U.S. PATENT DOCUMENTS 4,795,961 A * 1/1989 Neidorff ..... 323/314
4,931,718 A * 6/1990 Zitta ..... 323/313
5,339,272 A * 8/1994 Tedrow et al. ..... 323/316
5,451,860 A 9/1995 Khayat ..... 323/314
5,659,586 A * 8/1997 Chun ..... 375/355
5,670,815 A 9/1997 Childs et al. ..... 287/386
5,781,436 A * 7/1998 Forgang et al. ..... 364/422
5,821,807 A * 10/1998 Brooks ..... 327/539
5,834,926 A 11/1998 Kadanka ..... 327/313
5,861,771 A * 1/1999 Matsuda et al. ..... 323/316
5,867,047 A 2/1999 Kraus ..... 327/143
5,910,749 A * 6/1999 Kimura ..... 327/541
6,002,293 A * 12/1999 Brokaw ..... 323/313
6,018,235 A * 1/2000 Mikuni ..... 323/313
6,226,322 B1 * 5/2001 Mukherjee ..... 333/28 R

OTHER PUBLICATIONS

"Analog Integrated Circuit Design", by David A. Johns and Ken Martin, pp. 352–365.

* cited by examiner

*Primary Examiner*—Toan Tran
*Assistant Examiner*—Quan Tra
(74) *Attorney, Agent, or Firm*—Michael J. Donohue; Seed IP Law Group, PLLC

(57) ABSTRACT

A bandgap reference voltage circuit is provided that substantially prevents noise sensitivity. The bandgap reference voltage circuit includes an operational amplifier, transistors, and a resistive element on one input of the operational amplifier. The resistive element substantially prevents noise from creating a non-zero mean change in current across one of the transistors. Thus, the resistive element substantially precludes noise from being rectified by a transistor, so that the output reference voltage of the bandgap reference voltage circuit is substantially stable and fixed.

32 Claims, 8 Drawing Sheets

BANDGAP REFERENCE VOLTAGE WITH LOW NOISE SENSITIVITY

BACKGROUND OF THE INVENTION

1. Technical Field

This invention relates generally to bandgap reference voltage circuits and, more specifically, to a bandgap reference voltage circuit with substantial noise immunity.

2. Background Art and Technical Problems

In modern electronic circuits, there is a need for a precise reference voltage or power level. The reference voltage (or power level) maintains a baseline voltage level by which other voltages, power levels, and/or signals within the integrated circuit operate. A reference voltage must be consistent and precise so that other voltages, power levels, and/or signals can rely on its value as a standard within the integrated circuit. For example, the reference voltage should be immune to temperature variations, noise from the power supply, noise from high speed switching, and the like.

Some general examples of applications that use reference voltages include: audio codecs, digital subscriber line transceivers (for example, a High bit-rate Digital Subscriber Line (HDSL) or an Asymmetric Digital Subscriber Line (ADSL)), modems, and other communications circuits.

Typically, the reference voltage is generated based on a bandgap voltage, and is referenced to a power supply voltage, such as ground. When the reference circuit is integrated with other circuits, it becomes susceptible to noise generated by such other circuits. Prior methods of preventing the corruption of the reference voltage due to noise include: using external capacitors to isolate the reference circuit from noise, physically isolating the reference circuit from other parts of the circuit (e.g., layout techniques), and using supply isolation to isolate the power supply of the reference circuit from the power supply of other circuits.

In high speed switching, for example, the prior isolation methods have failed to adequately guard against changes in the reference voltage. By way of illustration, known reference voltage circuits could have a 20 percent change in reference voltage at a frequency of only 20 MHZ. Inherently, the 20 percent change in reference voltage is in the decreasing direction. Such changes in communications circuits, for example, result in decreased transmission power which is highly undesirable in communication devices.

In addition to poor power transmission issues, the required transmitted power is specified by various industry standards. For example, the European Telecommunications Standards Institute (ETSI) standard for HDSL recites a maximum permissible variation in transmitted power of +/−0.5 dB, which corresponds to an acceptable variation of about +/−5% in absolute transmitted power. Since there is a direct relationship between the transmitted power and the reference voltage, it is necessary to maintain a precise reference voltage in order to satisfy the ETSI standard of +/−0.5 dB.

Prior methods of isolating the reference voltage have failed to adequately guard against changes in the reference voltage, and have not sufficiently met the ETSI standard for absolute power transmitted. Thus, a reference voltage circuit and method for its use is needed which overcomes the shortcomings of the prior art.

SUMMARY OF THE INVENTION

In accordance with one aspect of the present invention, an improved reference voltage circuit is provided. The reference voltage circuit is substantially immune from high speed switching noise. In addition, the reference voltage circuit is substantially immune from power supply noise. A preferred embodiment of the subject reference voltage circuit includes, diode connected transistors, an operational amplifier, and a resistive element on one input of the operational amplifier configured to prevent spurious noise from creating a non-zero mean change in current across one of the diode connected transistor. In this way, the resistive element substantially reduces voltage fluctuations due to noise from being rectified by the diode connected transistor, and hence, from affecting the output reference voltage. Thus, an improved reference voltage circuit is provided that is substantially immune to noise.

BRIEF DESCRIPTION OF THE DRAWING FIGURES

The subject invention will hereinafter be described in the context of the appended drawing figures, wherein like numerals denote like elements, and:

DETAILED DESCRIPTION

Figure 1:
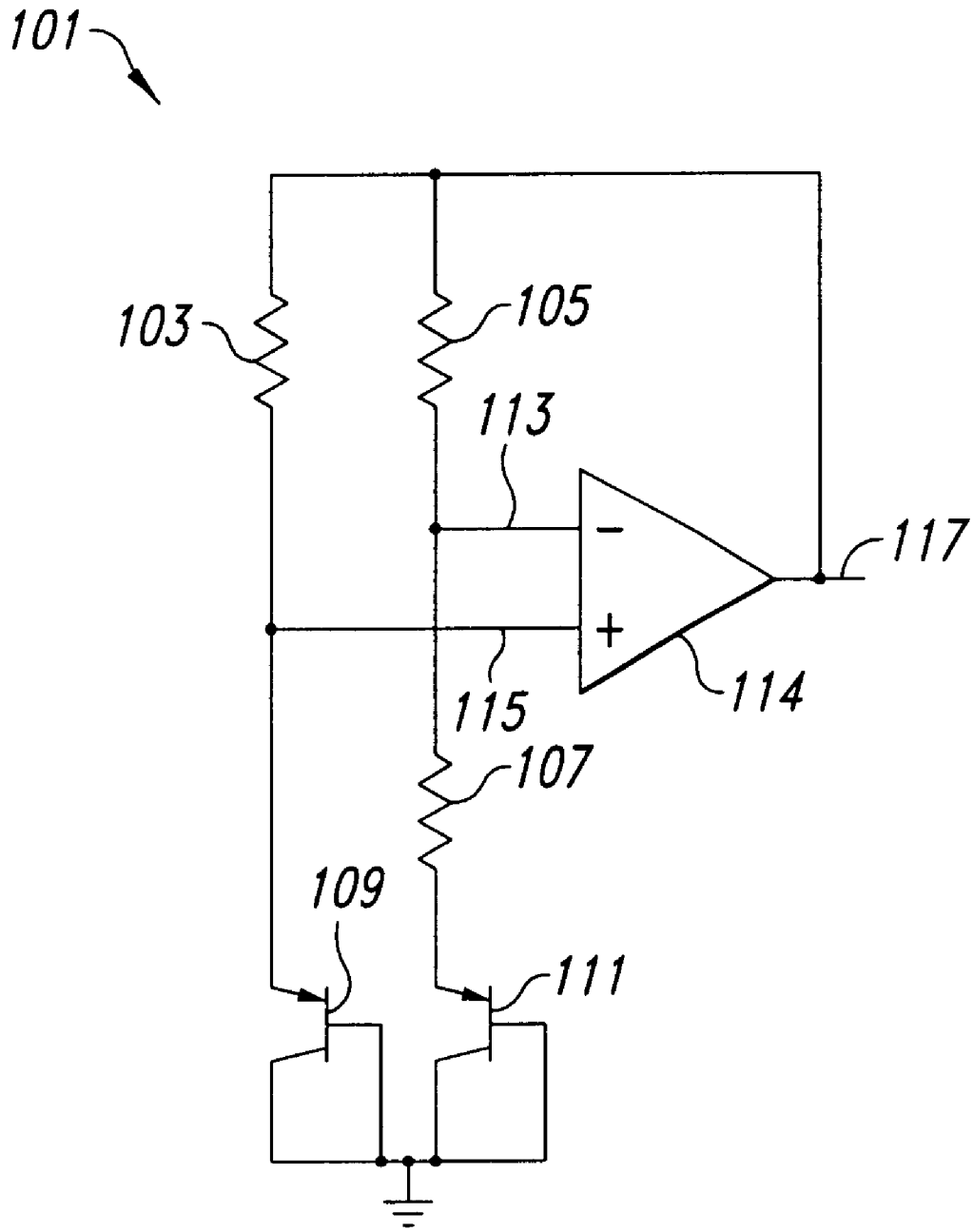
Fig. 1 (Prior Art)
FIG. 1 is a schematic diagram of a prior art reference voltage circuit.

Referring now to FIG. 1, a prior art reference voltage circuit 101 includes an operational amplifier 114 with an inverting input node 113 and a noninverting input node 115, a first resistor 103, a second resistor 105, a third resistor 107, a first transistor 109, a second transistor 111, and an output 117. First resistor 103 is coupled between first transistor 109 and output 117, and first transistor 109 is connected to ground. Second resistor 105 is coupled in series between third resistor 107 and output 117. Third resistor 107 is coupled in series between second resistor 105 and second transistor 111, and second transistor 111 is connected to ground. Inverting input node 113 is connected to the node between second resistor 105 and third resistor 107. Also, noninverting input node 115 is connected to the node between first resistor 103 and first transistor 109.

First and second transistors 109 and 111, respectively, are pnp Bipolar Junction Transistors configured as diodes. Current flows through first and second transistors 109 and 111, respectively. Generally, a reference voltage circuit comprises two transistors with differing current densities. For example, first and second transistors 109 and 111 may be the same size, but configured to have different current densities by making first resistor 103 greater than second resistor 105. Those skilled in the art will appreciate that, alternatively or in conjunction, the sizes of first and second transistors 109 and 111 may differ so that they may exhibit a corresponding difference in current densities.

Such differing current densities is a desired characteristic because any negative temperature dependence of the base-emitter voltage of first and second transistors 109 and 111, respectively, is canceled. Thus, the negative temperature dependence is canceled when the base-emitter junctions of first and second transistors 109 and 111, respectively, are biased with differing current densities. See, David A. Johns and Ken Martin, Analog Intergrated Circuit Design 353–364 (1997), which is hereby incorporated by reference. Current also flows through first resistor 103, second resistor 105, and third resistor 107. Inverting and noninverting input nodes 113 and 115, respectively, have negligible current flowing through them due to high impedance (i.e., capacitance) at the input nodes of operational amplifier 114, as is inherent in operational amplifiers. Reference voltage circuit 101 generates a reference voltage at output 117.

It is desirable to have a stable reference voltage at output 117. In this regard, third resistor 107 provides a DC gain and facilitates a steady state output signal at output 117. The reference voltage at output 117 should be immune to high speed switching noise, power supply noise, variations in temperature, and the like. As discussed above, the ETSI standard for acceptable variations in absolute power transmitted is +/−0.5 dB. However, reference voltage circuit 101 has excessive variations in reference voltage at output 117 which can translate directly into excessive variations in the absolute power transmitted in some applications.

Many types of noise can affect reference voltage circuit 101. For example, non-DC noise or changes in the reference voltage can adversely affect reference voltage circuit 101; however, such noise can often be removed by using a low-pass filter. Switching noise can also affect reference voltage circuit 101. Switching noise is inherently zero mean. Unfortunately, in some circumstances, zero mean switching noise coupled to reference voltage circuit 101 can cause a non-zero average change at output 117. This mishap is due to the rectifying behavior of diode-configured first and second transistors 109 and 111, respectively, which are integral to reference voltage circuit 101.

In particular, a zero mean change in voltage across one or both of first and second transistors 109 and 111, respectively, will produce a non-zero mean change in current through either or both of these. For example, a zero mean change in voltage across first transistor 109 will produce a non-zero mean change in current through first transistor 109. Likewise, a zero mean change in voltage across second transistor 111 will produce a non-zero mean change in current through second transistor 111. This is due to the rectifying behavior of these diode-configured transistors. Since diode-configured transistors are non-linear devices, they may produce a large current when conducting in one direction, but a small and opposite current when conducting in the opposite direction. Thus, the average or mean current change will be non-zero.

To further exemplify the problem, a positive voltage change across one of first and second transistors 109 and 111 has an associated large current change through that respective transistor. However, a negative voltage change on diode-configured first or second transistors 109 and 111 has an associated small and opposite current change through that respective transistor. Thus, although the average change in positive and negative voltages may be zero, the average change in the associated large and small currents will not be zero. Therefore, such a non-zero mean change in current often yields unacceptable voltage variations at output 117 of reference voltage circuit 101.

To better describe the effect of excessive variations in reference voltage on reference voltage circuit 101, consider adding noise between ground and the ground side connection of first transistor 109 and/or second transistor 111. The small signal circuit model would include replacing each of first and second transistors 109 and 111 with a parallel resistor and capacitor. In addition, operational amplifier 114 is modeled with a capacitance on each input.

Figure 2:
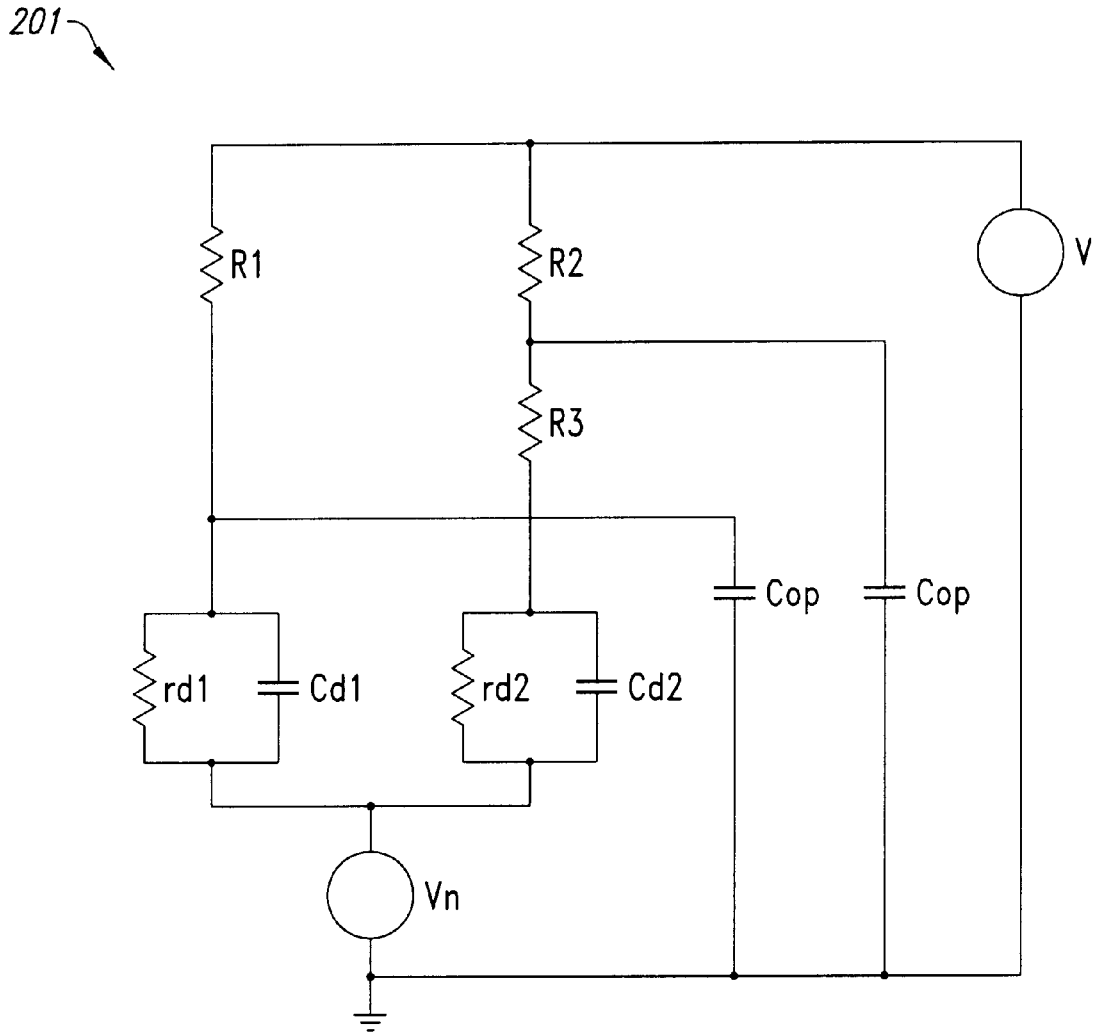
Fig. 2 (Prior Art)
FIG. 2 is a schematic diagram of the small signal circuit associated with FIG. 1.

FIG. 2 illustrates a small signal circuit 201 analogous in its configuration to reference voltage circuit 101. Small signal circuit 201 includes a first resistor R1, a second resistor R2, a third resistor R3, a first parallel resistor $r_{d1}$, a first parallel capacitor $c_{d1}$, a second parallel resistor $r_{d2}$, a second parallel capacitor $c_{d2}$, an operational amplifier capacitance $C_{op}$, a noise element $v_n$, and an ideal gain element v.

For frequencies higher than the bandwidth of operational amplifier 114, the voltage at output 117 of FIG. 1 will be fixed. When operational amplifier capacitance $C_{op}$ is large (e.g., approaches infinity), then the voltage $v_{d1}$ across first parallel resistor $r_{d1}$ and first parallel capacitor $c_{d1}$ is $v_{d1}=-v_n$ and the voltage $v_{d2}$ across second parallel resistor $r_{d2}$ and second parallel capacitor $c_{d2}$ is $v_{d2}=-v_n(z_{d2}/(R3+z_2))$, where $z_{d2}=r_{d2}/(1+s*c_{d2}*r_{d2})$, where s is a Laplace variable. Thus, $v_{d1}$ is approximately the same as the noise element $v_n$. However, the dependence of $v_{d2}$ on $v_n$ will be greatly reduced when R3 is large compared to $z_{d2}$. Thus, the noise element $v_n$ will be almost completely across first transistor 109. Therefore, first transistor 109 rectifies the noise element $v_n$ so that output 117 changes, which is highly undesirable.

Figure 3:
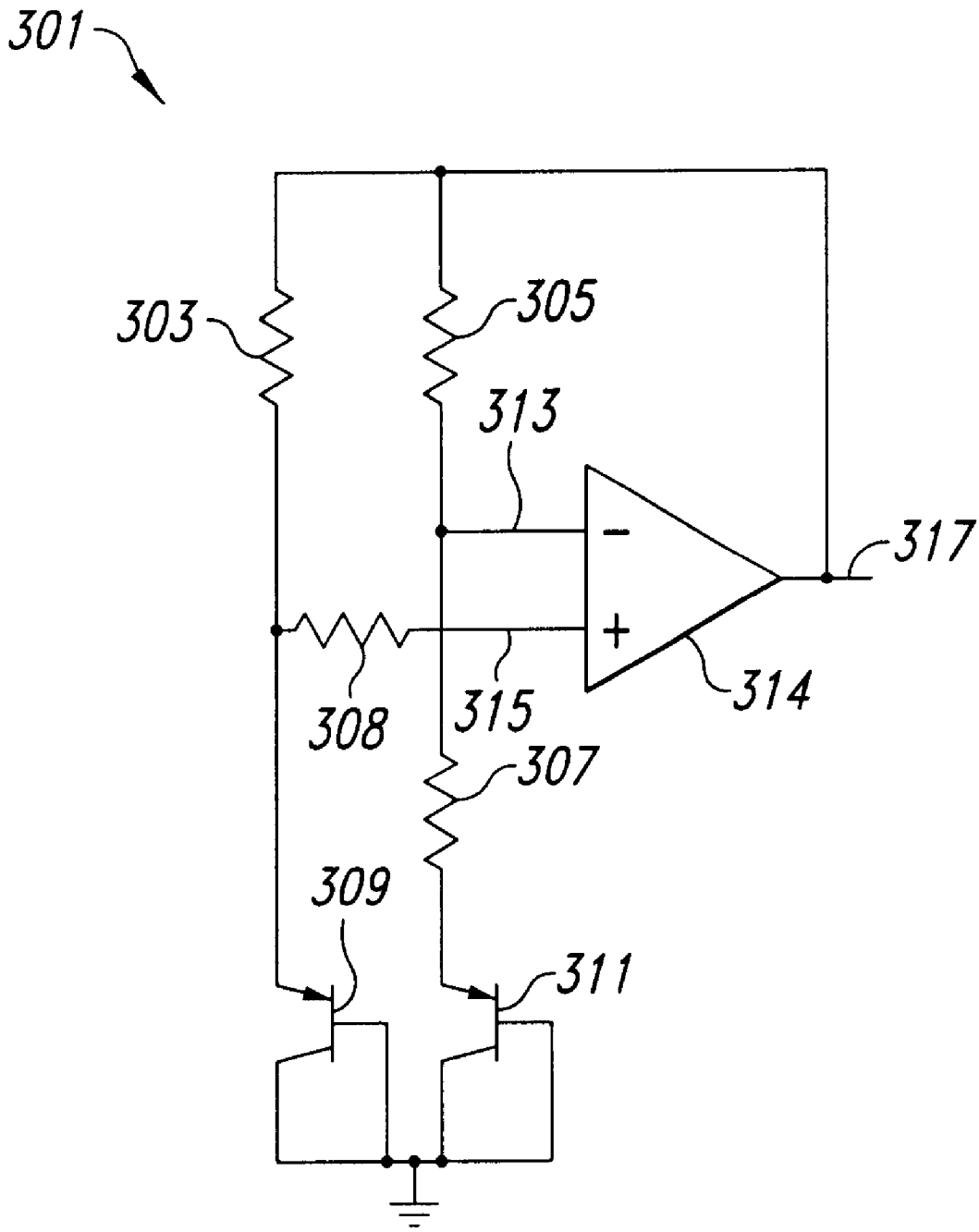
FIG. 3 is a schematic diagram of one embodiment of the present invention.

Referring now to FIG. 3, a preferred embodiment of the present invention is depicted in a suitable reference voltage circuit 301. Reference voltage circuit 301 is merely one example of a practical implementation of the present invention; the specific arrangement of reference voltage circuit 301 is not intended to limit the scope of the invention. Reference voltage circuit 301 includes an operational amplifier 314 with an inverting input node 313 and a noninverting input node 315, a first resistive element 303, a second resistive element 305, a third resistive element 307, a fourth resistive element 308, a first transistor 309, a second transistor 311, and an output 317. First resistive element 303 is coupled in series between first transistor 309 and output 317. In addition, fourth resistive element 308 is coupled between noninverting input node 315 and first transistor 309, and first transistor 309 is coupled to ground. Second resistive element 305 is coupled in series between third resistive element 307 and output 317. Third resistive element 307 is coupled in series between second resistive element 305 and second transistor 311, and second transistor 311 is coupled to ground. Inverting input node 313 is coupled to the node between second resistive element 305 and third resistive element 307.

First and second transistors 309 and 311 can be Bipolar Junction Transistors (BJTs) configured as diodes. Those skilled in the art will appreciate that first and second transistors 309 and 311 may comprise various types of transistors commonly used in integrated circuits. Current flows through first and second transistors 309 and 311. Current also flows through first resistive element 303, second resistive element 305, and third resistive element 307.

Generally, a reference voltage circuit comprises two transistors with differing current densities. For example, first and second transistors 309 and 311, respectively, may be the same size, but have different current densities by making first resistive element 303 greater than second resistive element 305, or vice versa. Those skilled in the art will appreciate that, alternatively or in conjunction, the sizes of first and second transistors 309 and 311, respectively, may differ in order to have a corresponding difference in current densities. Consequently, differing current densities of first and second transistors 309 and 311, respectively, cause the current through first transistor 309 to be different than the current through second transistor 311. Those skilled in the art will appreciate that the ratio of first transistor 309 to second transistor 311 should not be 1:1, preferably in the range of about 10:1 to about 100:1. Such differing current densities is a desired characteristic because any negative temperature dependence of the base-emitter voltage of first and second transistors 309 and 311, respectively, is canceled. Thus, the negative temperature dependence is canceled when the base-emitter junctions of first and second transistors 309 and 311, respectively, are biased with differing current densities. See, David A. Johns and Ken Martin, Analog Integrated Circuit Design 353–364 (1997).

Inverting and noninverting input nodes 313 and 315 have negligible current flowing through them due to high impedance (i.e., capacitance) at the input nodes of operational amplifier 314, as is inherent in operational amplifiers. Consequently, negligible current flows through fourth resistive element 308 because it is coupled to noninverting input node 315. Reference voltage circuit 301 generates a reference voltage at output 317.

Many kinds of noise can affect reference voltage circuit 301. For example, noise from ground will flow through second transistor 311 and third resistive element 307. As briefly discussed above in connection with FIG. 1, third resistive element 307 is configured to provide DC gain and a steady state output. However, the present inventor has determined that third resistive element 307 also reduces the effects of noise at high frequencies on second transistor 311, and hence reduces voltage variations at output 317. As explained above, a zero mean change in voltage across second transistor 311 may not have a corresponding zero mean change in current across second transistor 311. Accordingly, third resistive element 307 can decrease the effects of noise on output 317, as explained below.

Likewise, noise from ground will flow through first transistor 309 and fourth resistive element 308. Fourth resistive element 308 substantially prevents noise at high frequencies from affecting first transistor 309, and hence the reference voltage at output 317. As explained above, a zero mean change in voltage across first transistor 309 may not have a corresponding zero mean change in current across first transistor 309. This mishap is due to the non-linear operation of transistors. Thus, fourth resistive element 308 may be used to control the voltage across diode-configured first transistor 309, as discussed below.

Also, in accordance with this embodiment of the present invention, first and second transistors 309 and 311 can be N-well vertical pnp BJTs. The well of a vertical bipolar transistor is the base and the substrate is the collector. For example, an N-well vertical pnp transistor has its collector connected to ground. Alternatively, a P-well vertical npn transistor has its collector connected to a positive power supply. See, David A. Johns and Ken Martin, Analog Intergrated Circuit Design (1997), which is hereby incorporated by reference. Those skilled in the art will appreciate that other transistors may also be utilized, for example, BJTs, FETs, N-channel Metal-Oxide Semiconductor (NMOS), transistors made by Bipolar CMOS (Bi-CMOS), or the like.

To better describe the effect of excessive external noise on reference voltage circuit 301, consider adding noise between ground and the ground side connection of first and second transistors 309 and 311, respectively. The small signal model would include replacing each of first and second transistors 309 and 311, respectively, with a parallel resistive element and capacitive element for each transistor. In addition, operational amplifier 314 is modeled with a capacitance on each input associated with the input Field Effect Transistors (FETs) of operational amplifier 314.

Figure 4:
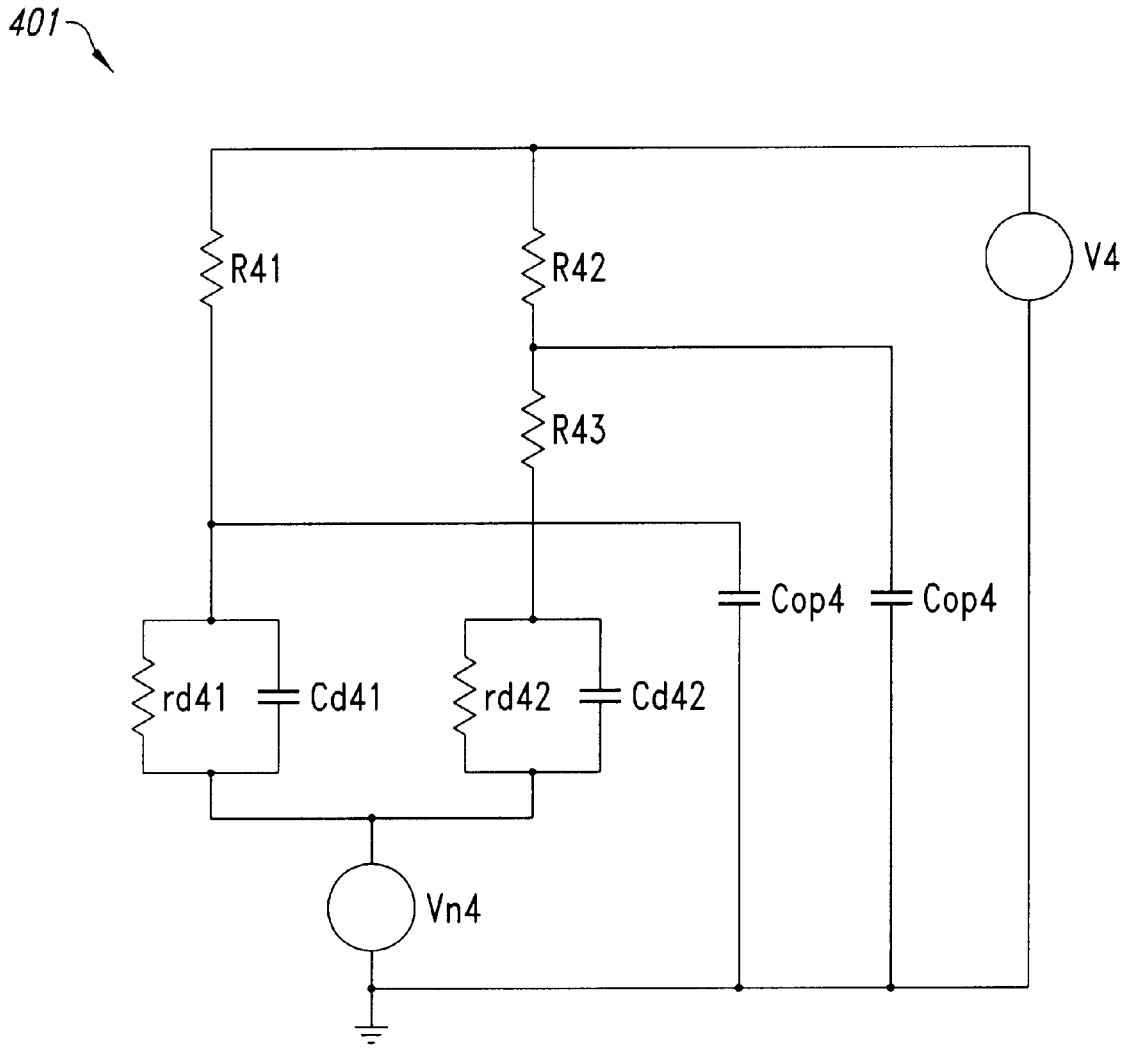
FIG. 4 is a schematic diagram of the small signal circuit associated with FIG. 3.

In analyzing the voltage characteristics of reference voltage circuit 301, it is instructive to consider the analogous small signal model of reference voltage circuit 301. FIG. 4 illustrates a small signal circuit 401 analogous in its configuration to reference voltage circuit 301. Small signal circuit 401 includes a first resistive element R41, a second resistive element R42, a third resistive element R43, a fourth resistive element R44, a first parallel resistive element $r_{d41}$, a first parallel capacitive element $C_{d41}$, a second parallel resistive element $r_{d42}$, a second parallel capacitive element $c_{d42}$, an operational amplifier capacitance $C_{op4}$, a noise element $v_{n4}$, and an ideal gain element v4.

With continued reference to FIGS. 3 and 4, for frequencies higher than the bandwidth of operational amplifier 314, the voltage at output 317 of FIG. 3 will be fixed. When operational amplifier capacitance $C_{op4}$ is large (e.g., approaches infinity), then the following occurs: (1) the voltage across first parallel resistive element $r_{d41}$ and first parallel capacitive element $c_{d41}$ is $v_{d41}=-v_{n4}(z_{d41}/[(R41*R44)/(R41+R44)+z_{d41}])$, where $z_{d41}=r_{d41}/(1+s*c_{d41}*r_{d41})$ and s is a Laplace transform variable; and (2) the voltage across second parallel resistive element $r_{d42}$ and second parallel capacitive element $c_{d42}$ is $v_{d42}=-v_{n4}(z_{d42}/(R43+z_{d42}))$, where $z_{d42}=r_{d42}/(1+s*c_{d42}*r_{d42})$ and s is a Laplace transform variable. Thus, the dependence of $v_{d41}$ on $v_{n4}$ is substantially reduced, as long as the parallel combination of R41 and R44 is sufficiently large compared to $z_{d41}$. In addition, the dependence of $v_{d42}$ on $v_{n4}$ will be greatly reduced when R43 is sufficiently large compared to $z_{d42}$. Thus, the effect of noise element $v_{n4}$ on $v_{d41}$ and $v_{d42}$ is greatly reduced so that output 317 remains fixed and stable.

In accordance with this embodiment of the present invention and as discussed above, the parallel combination of R41 and R44 should have a sufficiently large value in order to reduce the dependence of $v_{d41}$ on $v_{n4}$. Accordingly, the parallel combination of R41 and R44 should be large compared to $z_{d41}$ in order to reduce the dependence of $v_{d41}$ on $v_{n4}$. By way of illustration, taking $z_{d41}$=100 ohms and R41=12 kilo-ohms, the following simulation results exemplify various values for R44 and $v_{d41}/v_{n4}$: 0 kilo-ohms, 1.000; 0.0100 kilo-ohms, 0.9092; 0.0200 kilo-ohms, 0.8336; 0.0500 kilo-ohms, 0.6676; 0.1000 kilo-ohms, 0.5021; 0.2000 kilo-ohms, 0.3370; 05000 kilo-ohms, 0.1724; 1.0000 kiloohms, 0.0977; 2.0000 kilo-ohms, 0.0551; 5.0000 kilo-ohms, 0.0276; 10.0000 kilo-ohms, 0.0180; 20.0000 kilo-ohms, 0.0132; 50.0000 kilo-ohms, 0.0102; and 100.0000 kilo-ohms, 0.0092. In accordance with an exemplary embodiment of the present invention and in the context of the above illustrative simulations, a value of 1 kilo-ohm for R44 results in a ratio of $v_{d41}/v_{n4}$ of 0.0977. However, as discussed above, any values for R41 and R44 are suitable, as long as the parallel combination of R41 and R44 is sufficiently large compared to $z_{d41}$ in order to reduce the dependence of $v_{d4}$ on $v_{n4}$. Likewise, a similar range of values for R43 will yield a similar dependence of $v_{d42}$ on $v_{n4}$ as $v_{d41}$ on $v_{n4}$. Additionally, R43 should be sufficiently large compared to $z_{d42}$ in order to reduce the dependence of $v_{d42}$ on $v_{n4}$.

For the same reason and in the context of FIG. 3, the parallel combination of first resistive element 303 and fourth resistive element 308 should have sufficiently large values. Thus, one consideration that may affect which values are chosen for first resistive element 303 and fourth resistive element 308 is the undesired dependence of $v_{d41}$ on $v_{n4}$. Accordingly, first resistive element 303 and fourth resistive element 308 may have a range of values, as long as the parallel combination of first resistive element 303 and fourth resistive element 308 is large enough to reduce the undesired dependence of the voltage first transistor 309 on $v_{n4}$. Thus, fourth resistive element 308 decreases the dependence of the voltage across first transistor 309 on noise element $v_{n4}$. Therefore, fourth resistive element 308 substantially prevents noise at high frequencies from affecting the reference voltage at output 317. Likewise, third resistive element 307 should be sufficiently large in order to reduce the undesired dependence of the voltage across second transistor 311 on $v_{n4}$.

By way of illustration, first, second, third, and fourth resistive elements 303, 305, 307, and 308, respectively, can have values of 12 kilo-ohms, 28 kilo-ohms, 6 kilo-ohms, and 4 kilo-ohms, respectively. Of course, theses values simply represent one embodiment of the reference voltage circuit 301. Thus, any value for each of first, second, third, and fourth resistive elements 303, 305, 307, and 308 which results in a stable output reference voltage is suitable. Additionally, first resistive element 303, second resistive element 305, and third resistive element 307 are also chosen based on the temperature dependence characteristics of output 317. Likewise, those skilled in the art will appreciate that any element with resistive properties can be used for the resistive elements described above.

Figure 5:
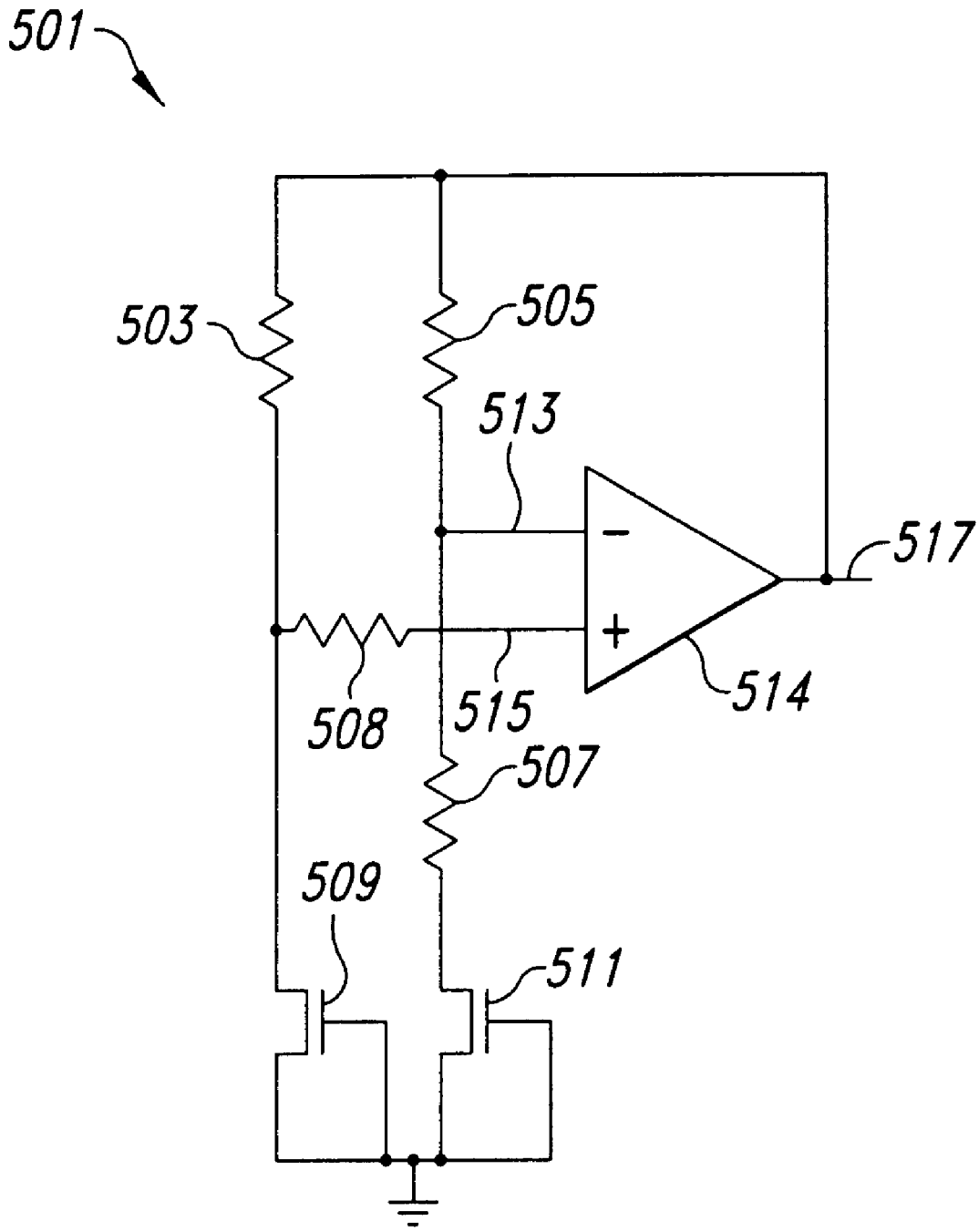
FIG. 5 is a schematic diagram of another embodiment of the present invention using Field Effect Transistors (FETs)

FIG. 5 illustrates an alternate embodiment of the present invention depicted in reference voltage circuit 501. Similar to reference voltage circuit 301 of FIG. 3, reference voltage circuit 501 includes an operational amplifier 514 with an inverting input node 513 and a noninverting input node 515, a first resistive element 503, a second resistive element 505, a third resistive element 507, a fourth resistive element 508, a first transistor 509, a second transistor 511, and an output 517. Reference voltage circuit 501 functions much the same way as does reference voltage circuit 301. However, first and second transistors. 509 and 511, respectively, are shown as FETs. Thus, reference voltage circuit 501 illustrates an alternative embodiment of reference voltage circuit 301 using FETs.

Figure 6:
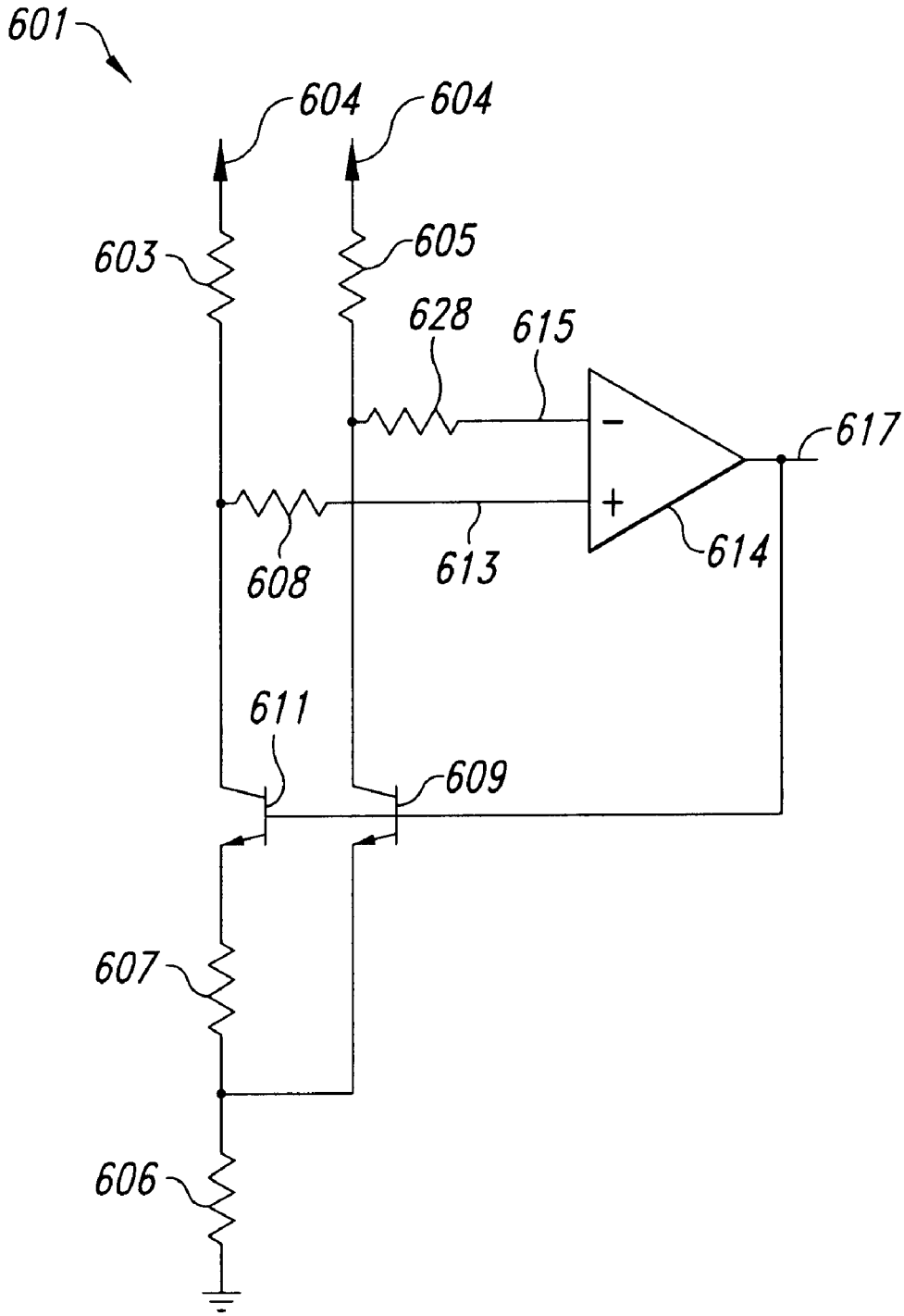
FIG. 6 is a schematic diagram of another embodiment of the present invention using Bipolar Junction Transistors (BJTs)

FIG. 6 illustrates another embodiment of the present invention depicted in reference voltage circuit 601. Similar to reference voltage circuits 301 of FIG. 3 and 501 of FIG. 5, reference voltage circuit 601 includes an operational amplifier 614 with an inverting input node 613 and a noninverting input node 615, a first resistive element 603, a second element 605, a third resistive element 607, a fourth resistive element 606, a fifth resistive element 608, sixth resistive element 628, a first transistor 609, a second transistor 611, a power supply 604, and an output 617.

Reference voltage circuit 601 functions much the same way as do reference voltage circuits 301 and 501. However, first and second transistors 609 and 611, respectively, are shown as npn BJTs. In addition, the circuit configuration is modified. First resistive element 603 and second resistive element 605 are coupled to power supply 604, and third resistive element 607 and fourth resistive element 606 are coupled, in series, between second transistor 611 and ground, respectively. Fifth resistive element 608 is coupled between second transistor 611 and inverting input node 613. Sixth resistive element 628 is coupled between first transistor 609 and noninverting input node 615. Also, output 617 is fed back to first and second transistors 609 and 611. Thus, reference voltage circuit 601 illustrates an alternative embodiment of reference voltage circuits 301 and 501 using npn BJTs.

Figure 7:
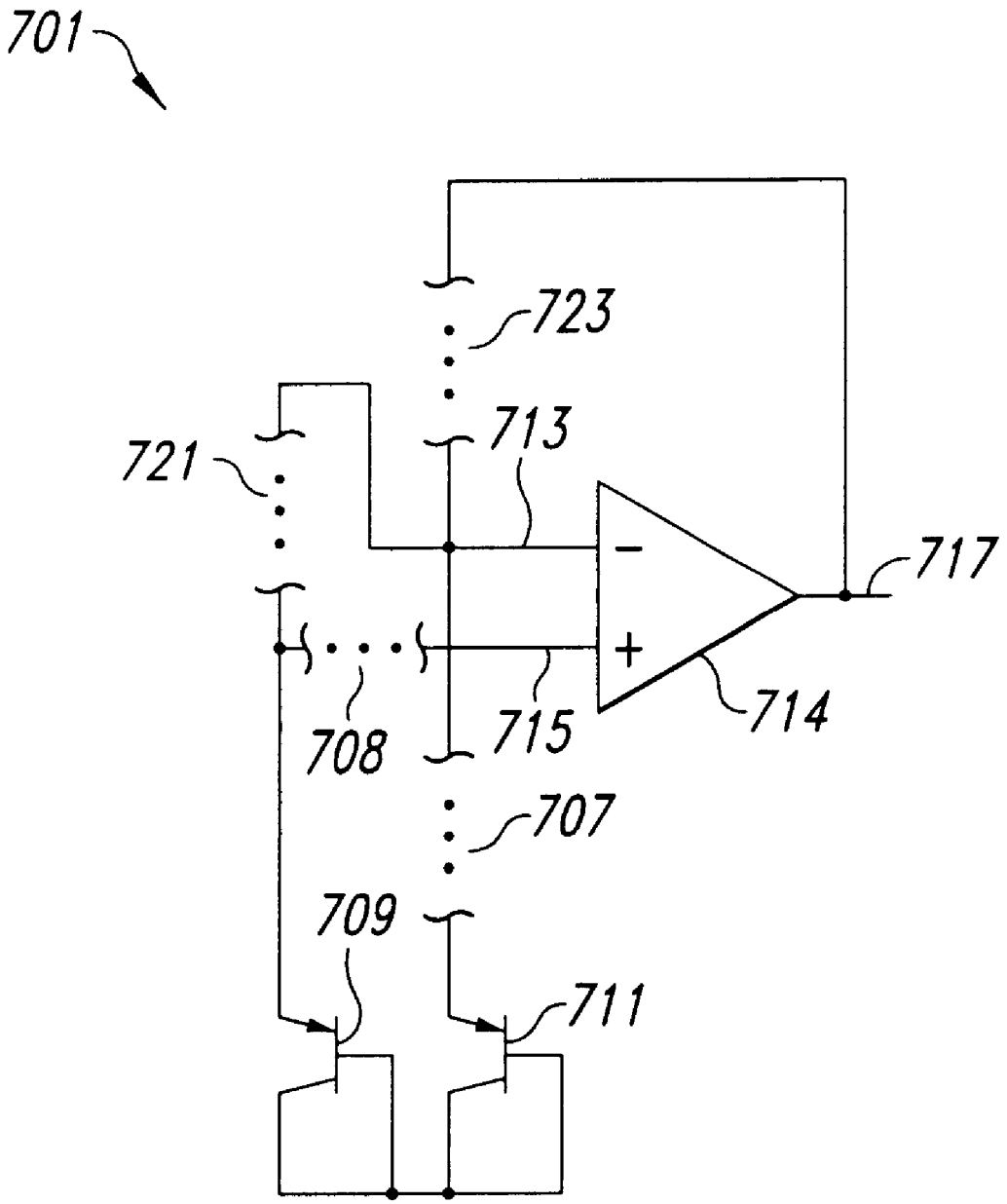
FIG. 7 is a schematic diagram of a generalized embodiment of the present invention.

FIG. 7 illustrates a generalized embodiment of the present invention depicted in reference voltage circuit 701. Reference voltage circuit 701 includes an operational amplifier 714 with an inverting input node 713 and a noninverting input node 715, a first transistor 709, a second transistor 711, an output 717, a first component section 721, a second component section 723, a third component section 708, and a fourth component section 707. First, second, third, and fourth component sections 721, 723, 708, and 707, respectively, can flexibly include any number of elements having resistive characteristics. Those skilled in the art will appreciate that first, second, third, and fourth component sections 721, 723, 708, and 707, respectively, can include any number of resistive elements commonly used in integrated circuits, or the like. Reference voltage circuit 701 functions much the same way as does reference voltage circuits 301, 501, and 601.

Figure 8:
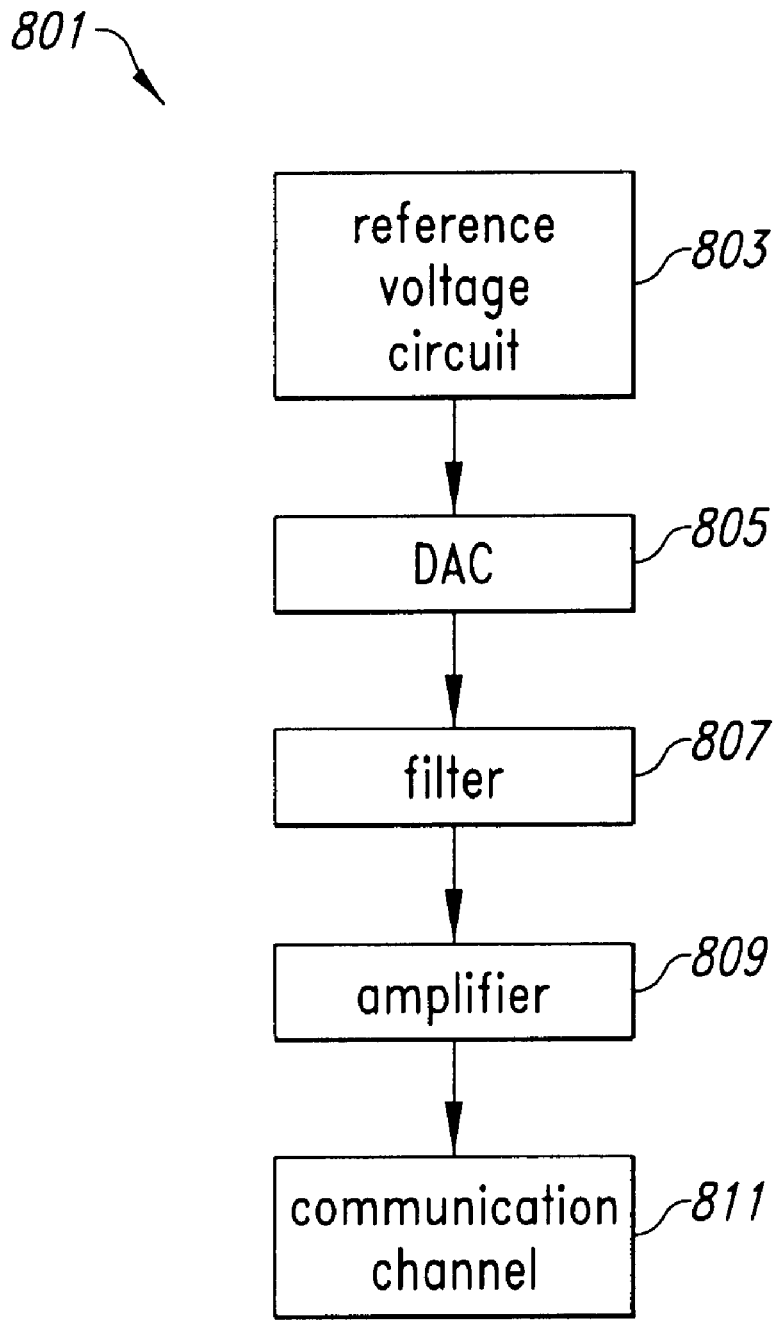
FIG. 8 is a schematic diagram of a Digital Subscriber Line (DSL) transmitter.

Referring now to FIG. 8, a Digital Subscriber Line (DSL) transmitter 801 may include a reference voltage circuit 803, a digital to analog converter (DAC) 805, a filter 807, an amplifier 809, and a communication channel 811. Digital symbols are inputted into DAC 805, filtered through filter 807, and amplified by amplifier 809 before entering communication channel 811. Reference voltage circuit 803 can be any of reference voltage circuits 301, 501, 601, and 701. DSL transmitter 801 illustrates one application in which a reference voltage is used. Those skilled in the art will appreciate that any application requiring a stable reference voltage may use reference voltage circuits including: audio codecs, digital subscriber line transceivers (for example, a High bit-rate Digital Subscriber Line (HDSL) or an Asymmetric Digital Subscriber Line (ADSL)), modems, or other communications circuits.

Although the invention has been described herein with reference to the appended drawing figures, it will be appreciated that the scope of the invention is not so limited. Various modifications in the design and implementation of various components and method steps discussed herein may be made without departing from the spirit and scope of the invention, as set forth in the appended claims.

What is claimed is:

1. A bandgap reference voltage circuit, comprising:

an operational amplifier having a first input node, a second input node, and an output node configured to output a reference voltage;

a first transistor configured for electrical communication with said first input node and having a first resistive element configured for electrical communication with and in series between said first transistor and said first input node, said first resistive element having a resistance value greater than an impedance of said first transistor;

a second transistor configured for electrical communication with said second input node and having a second resistive element configured for electrical communication with and in series between said second transistor and said second input node, said second resistive element having a resistance value greater than an impedance of said second transistor; and a feedback loop configured to feed said reference voltage back to said first input node through a third resistive element, and wherein the parallel combination of said first resistive element and said third resistive element is large compared to the impedance of said first transistor.

2. The circuit of claim 1, wherein said first and second transistors are each emitter coupled to said operational amplifier.

3. The circuit of claim 2, wherein said first and second transistors are each diode-connected.

4. The circuit of claim 3, further comprising a feedback loop configured to feed said reference voltage back to said second input node through a fourth resistive element, and wherein said second resistive element is large compared to the impedance of said second transistor.

5. The circuit of claim 1, further comprising a feedback loop wherein said reference voltage is fed back to said second input node.

6. The circuit of claim 1, wherein said first and second transistors are electrically connected to ground.

7. The circuit of claim 1, wherein the collectors of said first and second transistors are configured for electrical communication with ground.

8. The circuit of claim 1, wherein said first and second transistors are Bipolar Junction Transistors (BJTs), and wherein the collectors and bases of said first and second transistors are configured for electrical communication with ground.

9. The circuit of claim 1, wherein the current density of said first transistor is different from the current density of said second transistor.

10. The circuit of claim 1, wherein the ratio of the current density of said first transistor to the current density of said second transistor is in the range of about 10:1 to about 100:1.

11. The circuit of claim 1, wherein said first and second transistors are Field Effect Transistors (FETs).

12. A bandgap reference voltage circuit, comprising:

an operational amplifier having a first input node, a second input node, and an output node configured to output a reference voltage;

a first transistor configured for electrical communication with said first input node and having a first resistive element configured for electrical communication with and in series between said first transistor and said first input node, said first resistive element having a resistance value greater than an impedance of said first transistor; and a second transistor configured for electrical communication with said second input node and having a second resistive element configured for electrical communication with and in series between said second transistor and said second input node, said second resistive element having a resistive value greater than an impedance of said second transistor; wherein said first and second transistors are each emitter coupled to said operational amplifier;

said first and second transistors are each diode-connected;

the current density of said first transistor is different from the current density of said second transistor; and further comprising a feedback loop configured to feed said reference voltage back to said first input node through a third resistive element, and wherein the parallel combination of said first resistive element and said third resistive element is large compared to the impedance of said first transistor; and wherein said feedback loop is configured to feed said reference voltage back to said second input node through a fourth resistive element, and wherein said second resistive element is large compared to the impedance of said second transistor.

13. A bandgap reference voltage circuit, comprising:

an operational amplifier having a first input node, a second input node, and an output node configured to output a reference voltage;

a first transistor configured for electrical communication with said first input node and having a first resistive element configured for electrical communication with and in series between said first transistor and said first input node, said first resistive element having a resistance value greater than an impedance of said first transistor;

a second transistor configured for electrical communication with said second input node and having a second resistive element configured for electrical communication with and in series between said second transistor and said second input node, said second resistive element having a resistive value greater than an impedance of said second transistor;

a third resistive element in series between said first transistor and ground;

a fourth resistive element coupled to said second transistor and said third resistive element;

a fifth resistive element coupled to said first transistor, said first resistive element, and a power supply;

a sixth resistive: element coupled to said second transistor, said second resistive element, and said power supply; and a feedback loop coupled between said output node, said first transistor, and said second to transistor.

14. A method for maintaining a reference voltage at a circuit output, comprising the steps of:

configuring an operational amplifier to have a first input, a second input, and an output;

coupling a first resistive element between said first input and a first transistor, said first resistive element having a resistance value greater than an impedance of said first transistor;

coupling a second resistive element between said second input and a second transistor, said second resistive element having a resistance value greater than an impedance of said second transistor;

providing a reference voltage at said output; and coupling a third resistive element between said first input and said output, and configuring the parallel combination of said first resistive element and said third resistive element to be large compared top the impedance of said first transistor.

15. The method of claim 14 further comprising the step of coupling a fourth resistive element between said second input and said output, and configuring said second resistive element to be large compared to the impedance of said second transistor.

16. The method of claim 14 further comprising the step of coupling the collectors and bases of said first and second transistors to ground.

17. The method of claim 14 further comprising the step of emitter coupling each of said first and second transistors to said operational amplifier.

18. The method of claim 14 further comprising the step of configuring said first transistor to have a current density different from the current density of said second transistor.

19. The method of claim 14 further comprising the step of configuring said first and second transistors to have a current density ratio in the range of about 10:1 to about 100:1.

20. The method of claim 14 further comprising the step of configuring said first and second transistors as Bipolar Junction Transistors (BJTs), and configuring the collectors and bases of said first and second transistors for electrical communication with ground.

21. The method of claim 14 further comprising the steps of coupling a third resistive element between said first input and said output, and configuring the parallel combination of said first resistive element and said third resistive element to be large compared to the impedance of said first transistor;

coupling a four resistive element between said second input and said output, and configuring said second resistive element to be large compared to the impedance of said second transistor;

coupling the collectors and bases of said first and second transistors to ground;

emitter coupling each of said first and second transistors to said operational amplifier;

configuring said first transistor to have a current density different from the current density of said second transistor; and configuring said first and second transistors as Bipolar Junction Transistors (BJTs).

22. A transmitter used in Digital Subscriber Lines (DSLs), comprising:

a digital to analog converter (DAC);

a filter;

an amplifier;

a communications channel; and a bandgap reference voltage circuit, including:

an operational amplifier having a first input node, a second input node, and an output node configured to output a reference voltage;

a first transistor configured for electrical communication with said first input node and having a first resistive element configured for electrical communication with and in series between said first transistor and said first input node, said first resistive element having a resistance value greater than an impedance of said first transistor;

a second transistor configured for electrical communication with said second input node and having a second resistive element configured for electrical communication with and in series between said second transistor and said second input node, said second resistive element having a resistance value greater than an impedance said second transistor; and a feedback loop configured to feed said reference voltage back to said first input node through a third resistive element, and wherein the parallel combination of said first resistive element and said third resistive element is large compared to the impedance of said first transistor.

23. The circuit of claim 1, wherein said first resistive element has a value between about 0.01 kilo-ohms to about 100 kilo-ohms.

24. The circuit of claim 23, wherein said second resistive element has a value of about 12 kilo-ohms.

25. The circuit of claim 1, wherein said first resistive element includes at least one of a resistor, a capacitor, and a passive resistor with linear proportionality to voltage.

26. The circuit of claim 1, wherein said second resistive element includes at least one of a resistor, a capacitor, and a passive resistor with linear proportionality to voltage.

27. The circuit of claim 1, wherein said first resistive element is not a transistor.

28. The circuit of claim 1, wherein said second resistive element is not a transistor.

29. The circuit of claim 1, wherein said first and second transistors are each emitter coupled directly to said operational amplifier by said first and second resistive elements, respectively.

30. A bandgap reference voltage circuit, comprising:

an operational amplifier having a first input node, a second input node, and an output node configured to output a reference voltage;

a first transistor configured for electrical communication with said first input node and having a first resistive element, in addition to any inherent parasitic resistive element between said first transistor and said first input node, configured for electrical communication with and in series between said first transistor and said first input node, said first resistive element having a first resistance value;

a second transistor configured for electrical communication with said second input node and having a second resistive element, in addition to any inherent parasitic resistive element between said second transistor and said second input node, configured for electrical communication with and in series between said second transistor and said second input node, said second resistive element having a second resistance value; and a feedback loop configured to feed said reference voltage back to said first input node through a third resistive element, and wherein the parallel combination of said first resistive element and said third resistive element is large compared to the impedance of said first transistor.

31. A method for maintaining a reference voltage at a circuit output, comprising the steps of:

configuring an operational amplifier to have a first input, a second input, and an output;

coupling a first resistive element between said first input and a first transistor, wherein said first resistive element is in addition to any inherent parasitic resistive element between said first input and said first transistor and has a first resistance value;

coupling a second resistive element between said second input and a second transistor, wherein said second resistive element is in addition to any inherent parasitic resistive element between said second input and said second transistor and has a second resistance value;

providing a reference voltage at said output; and coupling a third resistive; element between said first input and said output, and configuring the parallel combination of said first resistive element and said third resistive element to be large compared to the impedance of said first transistors.

32. A transmitter used in Digital Subscriber Lines (DSLs), comprising:

a digital to analog converter (DAC);

a filter;

an amplifier;

a communications channel; and a bandgap reference voltage circuit, including:

an operational amplifier having a first input node, a second input node, and an output node configured to output a reference voltage;

a first transistor configured for electrical communication with said first input node and having a first resistive element, in addition to any inherent parasitic resistive element between said first transistor and said first input node, configured for electrical communication with and in series between said first transistor and said first input node, said first resistive element having a first resistance value;

a second transistor configured for electrical communication with said second input node and having a second resistive element, in addition to any inherent parasitic resistive element between said second transistor and said second input node, configured for electrical communication with and in series between said second transistor and said second input node, said second resistive element having a second resistance value; and a feedback loop configured to feed said reference voltage back to said first input node through a third resistive element, and wherein the parallel combination of said first resistive element and said third resistive element is large compared to the impedance of said first transistor.

* * * * *